US012030708B2

(12) United States Patent
Martin et al.

(10) Patent No.: US 12,030,708 B2
(45) Date of Patent: Jul. 9, 2024

(54) FRAME END CAP PACKAGE

(71) Applicant: LIBERTY HARDWARE MFG. CORP., Winston-Salem, NC (US)

(72) Inventors: Ryan Martin, Kernersville, NC (US); Earl David Forrest, Asheboro, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

(21) Appl. No.: 17/978,628

(22) Filed: Nov. 1, 2022

(65) Prior Publication Data

US 2023/0045942 A1 Feb. 16, 2023

Related U.S. Application Data

(62) Division of application No. 16/847,089, filed on Apr. 13, 2020, now Pat. No. 11,518,598, which is a division of application No. 15/652,415, filed on Jul. 18, 2017, now Pat. No. 10,654,638.

(60) Provisional application No. 62/419,587, filed on Nov. 9, 2016.

(51) Int. Cl.
*B65D 81/05* (2006.01)
*B65D 5/50* (2006.01)

(52) U.S. Cl.
CPC ..... *B65D 81/057* (2013.01); *B65D 5/5052* (2013.01); *B65D 5/5071* (2013.01); *B65D 81/058* (2013.01)

(58) Field of Classification Search
CPC .. B65D 81/057; B65D 81/053; B65D 81/054; B65D 81/055; B65D 81/056; B65D 81/058; B65D 81/107; B65D 5/5071; B65D 5/5069; B65D 5/5047; B65D 5/505; B65D 5/5052; B65D 5/5043; B65D 5/5057
USPC ..... 206/586, 453, 588, 521, 590
See application file for complete search history.

(56) References Cited

U.S. PATENT DOCUMENTS

| | | | | |
|---|---|---|---|---|
| 2,006,224 | A | 6/1935 | Weber et al. | |
| 2,885,139 | A | 5/1959 | Werner et al. | |
| 3,349,984 | A | 10/1967 | Halko, Jr. | |
| 4,127,192 | A | 11/1978 | Card | |
| 4,134,496 | A | 1/1979 | Smith | |
| 4,974,352 | A | 12/1990 | Chen | |
| 4,993,953 | A | 2/1991 | Stein | |
| 6,997,323 | B2 * | 2/2006 | Maresh | B65D 5/5069 206/592 |
| 2007/0051659 | A1 | 3/2007 | Sattora et al. | |

(Continued)

*Primary Examiner* — Andrew D Perreault
(74) *Attorney, Agent, or Firm* — Brooks Kushman P.C.; Lora Graentzdoerffer

(57) ABSTRACT

A frame package including a back panel, an inside panel tab, a front panel, and an inside panel is provided. The inside panel tab extends from the back panel. The front panel extends from the back panel and defines a region to rest upon a corner portion of a frame. The inside panel extends from the front panel and includes an inside panel tab slot. The back panel, the front panel, and the inside panel are arranged with one another to fold about the corner portion of the frame and for the inside panel to extend through a frame opening such that the corner portion of the frame is covered by at least one of the back panel and the front panel. The inside panel tab is received within the inside panel tab slot to secure the back panel to the inside panel without an additional fastener.

18 Claims, 6 Drawing Sheets

(56) References Cited

U.S. PATENT DOCUMENTS

| | | | |
|---|---|---|---|
| 2008/0179216 | A1 | 7/2008 | Kari |
| 2012/0160904 | A1 | 6/2012 | Scior et al. |
| 2014/0262924 | A1 | 9/2014 | Titkos |

* cited by examiner

FRAME END CAP PACKAGE

CROSS-REFERENCE TO RELATED APPLICATIONS

This application is a division of U.S. application Ser. No. 16/847,089 filed Apr. 13, 2020, now U.S. Pat. No. 11,518,598 B2, which, in turn, is a division of U.S. application Ser. No. 15/652,415 filed Jul. 18, 2017, now U.S. Pat. No. 10,654,638 B2, which, in turn, claims the benefit of U.S. provisional application Ser. No. 62/419,587 filed Nov. 9, 2016, the disclosures of which are hereby incorporated in their entirety by reference herein.

TECHNICAL FIELD

Various embodiments relate to package bodies for frames.

BACKGROUND

Prior art packaging for frames is often secured directly to the frame.

SUMMARY

According to at least one embodiment, a package body for a frame includes a back panel, a front panel, and a bottom panel. The back panel includes at least one panel tab. The front panel defines an area to rest upon a portion of a frame. The bottom panel defines at least one back panel slot. The panels are arranged with one another for folding about the portion of the frame, through a frame opening, and such that the back panel tab is oriented for insertion within the back panel slot.

According to at least another embodiment, a method for securing a package body to a frame without mechanical fastening includes positioning a frame upon a front panel of a package body, folding a portion of a bottom panel through an opening defined by the frame, and folding a portion of a back panel over the frame and securing the back panel to the bottom panel such that the package body is secured to the frame without mechanical fasteners.

According to at least another embodiment, a frame package includes a back panel, an inside panel tab, a front panel, and an inside panel. The inside panel tab extends from the back panel. The front panel extends from the back panel and defines a region to rest upon a corner portion of a frame. The inside panel extends from the front panel and includes an inside panel tab slot. The back panel, the front panel, and the inside panel are arranged with one another to fold about the corner portion of the frame and for the inside panel to extend through a frame opening such that the corner portion of the frame is covered by at least one of the back panel and the front panel. The inside panel tab is received within the inside panel tab slot to secure the back panel to the inside panel without an additional fastener and with the corner portion of the frame disposed therebetween. A rollover flap may extend from the front panel with a flap slot sized to receive a side panel tab of the back panel to secure the back panel to the rollover flap with the corner portion of the frame disposed therebetween. The rollover flap may include a first portion foldably extending from a side flap portion at a flap seam. The side flap portion may be shaped for concealment under the back panel when secured to the inside panel. The back panel may further include a triangle-shaped portion foldably extending from a side portion at a back panel seam. The inside panel tab may be shaped for insertion within the inside panel tab slot to further secure the frame package to the frame without an additional fastener. The inside panel may include a first flap and a second flap extending from the inside panel in an orientation perpendicular to one another. Each of the first flap and the second flap may be sized to fold over to reinforce a portion of the frame package located adjacent an inner corner of the frame opening. The back panel and the front panel may each define a triangle shape. A packaged frame assembly may include a decorative frame with a plurality of corners and a plurality of the frame packages each installed upon one of the plurality of corners of the decorative frame.

According to at least another embodiment, a frame package includes a front panel, a back panel, at least one back panel tab, and a bottom panel. The front panel has a region for resting upon a lateral portion of a frame. The back panel extends from a first side of the front panel. The at least one back panel tab extends from the back panel. The bottom panel extends from a second side of the front panel and has at least one back panel tab slot. The front panel, the back panel, and the bottom panel are arranged with one another to fold about the lateral portion of the frame and for the bottom panel to extend through a frame opening to orient the at least one back panel tab to be received within the at least one back panel tab slot to secure the back panel to the bottom panel without an additional fastener and with the lateral portion of the frame disposed therebetween. The front panel may include a first side panel and a second side panel each extending from opposing sides of the front panel and each with a side panel slot. The back panel may further include a first side panel tab and a second side panel tab. The first side panel tab and the second side panel tab may each be sized for insertion within one of the side panel slots to secure the back panel to the first side panel and the second side panel. The front panel, the back panel, and the bottom panel may be further arranged with one another to fold about the lateral portion of the frame such that the front panel and the back panel cover two corners of the frame on either side of the lateral portion. The back panel tab may be sized for insertion within the back panel tab slot to secure the back panel to the bottom panel without an additional fastener. The back panel may have a rectangular shape having an area greater than an area of the bottom panel.

According to at least another embodiment, a frame package includes a front panel, a back panel, at least one back panel tab, and a bottom panel. The front panel has a region for resting upon an angled portion of a frame. The back panel extends from a first side of the front panel. The at least one back panel tab extends from the back panel. The bottom panel extends from a second side of the front panel and has at least one back panel tab slot. The front panel, the back panel, and the bottom panel are arranged with one another to fold about the angled portion of the frame and for the bottom panel to extend through a frame opening to orient the at least one back panel tab to be received within the at least one back panel tab slot to secure the back panel to the bottom panel with the angled portion of the frame disposed therebetween. The frame package may further include a pair of side panels each extending from opposite sides of the front panel and each having a side panel slot. The back panel may further include at least one side panel tab extending in a direction perpendicular to a direction in which the back panel extends. The at least one side panel tab may be sized for insertion within one of the side panel slots to secure the back panel to the front panel. The frame package may further include a pair of angle panels each extending from one of two angled portions of the front panel and each with an angle panel slot sized to receive an angle panel tab extending from the back panel. Each of the pair of angle panels may be shaped to conceal a portion of the angled portion of the frame. The front panel, the back panel, and the bottom panel may further be arranged with one another such that receipt by the back panel tab slot of the at least one back panel tab further secures the back panel to the bottom panel without an additional fastener. A packaged frame assembly may include a decorative frame having at least one angled portion and the frame package installed upon the at least one angled portion of the decorative frame.

DETAILED DESCRIPTION

As required, detailed embodiments of the present invention are disclosed herein; however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ embodiments of the present disclosure.

Typical frame end caps are mounted directly to the frame via additional fasteners such as stapes or an adhesive such as glue. Removal of the fastener or adhesive may damage the frame or a mount surface for the frame where not all of the fastener is removed entirely.

Figure 1:
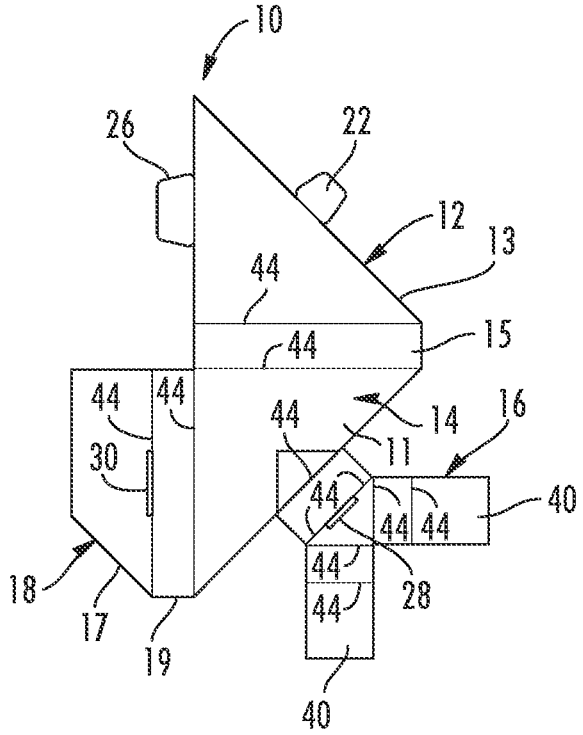
FIG. 1 is a plan view of an example of a package body unfolded and for securing to a frame.

FIG. 1 shows an example of a portion of a frame package including a package body for a frame, referred to generally as a package body 10 herein. The package body 10 may include a back panel 12, a front panel 14, an inside panel 16, and a rollover flap 18. The back panel 12 may include triangular-shaped portion 13 and a first side portion 15. It is contemplated that portions of the back panel 12 may define various shapes other than a triangle. An inside panel tab 22 and a side panel tab 26 may extend from the triangular-shaped portion 13 of the back panel 12. The front panel 14 may include a region 11 sized to rest upon a portion of a frame, such as a corner of a picture frame or mirror frame. The inside panel 16 may define an inside panel tab slot 28 sized to receive the inside panel tab 22. The rollover flap 18 may include a first portion 17 and a second side portion 19. The rollover flap 18 may define a side panel slot 30 at a seam between the first portion 17 and the second side portion 19. The side panel slot 30 may be sized to receive the side panel tab 26.

The first side portion 15 and the second side portion 19 may be sized according to a size of the frame 36 so that the back panel 12 and the rollover flap 18 may rest snuggly upon the frame 36 when the package body 10 is secured thereto.

Figure 2:
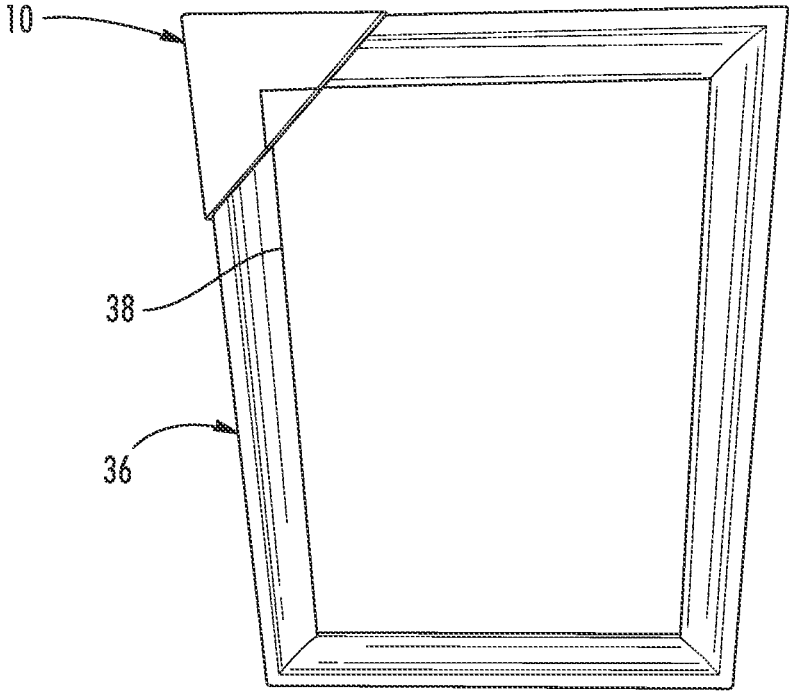
FIG. 2 is a perspective view of the package body of FIG. 1 shown mounted to a portion of a frame.

The panels and the rollover flap 18 of the package body 10 may be arranged with one another to fold about a corner of a frame and through an opening defined by the frame. For example, FIG. 2 shows an example of a frame 36 with an opening 38 and the package body 10 secured to a corner portion of the frame 36. The package body 10 is secured to the frame 36 without an additional fastener. While this example shows tabs for insertion with slots, it is contemplated that other configurations are available in which a portion of the package body 10 is secured to another portion of the package body 10 and not secured to the frame 36.

The package body 10 may include fold seams 44 located at portions of the package body 10 to assist in facilitating securement of the package body 10 to the frame 36. The fold seams 44 may be pre-scored and include fold instruction indicia adjacent thereto (e.g. "Fold along this line."). Panels and tabs adjacent the fold seams 44 may fold in either direction about the respective fold seam 44.

Figure 3A:
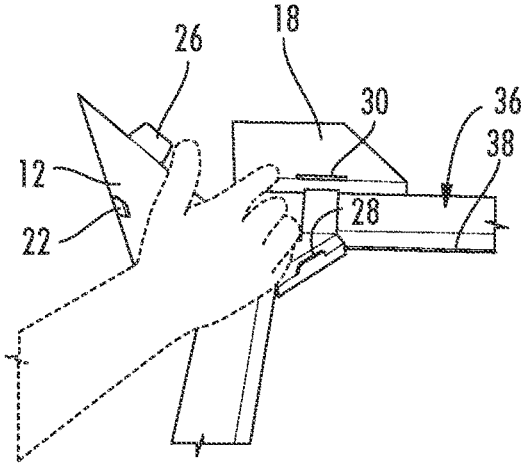
FIG. 3A is a perspective view of a step of a mounting procedure to mount the package body of FIG. 1 to the frame of FIG. 2.
Figure 3B:
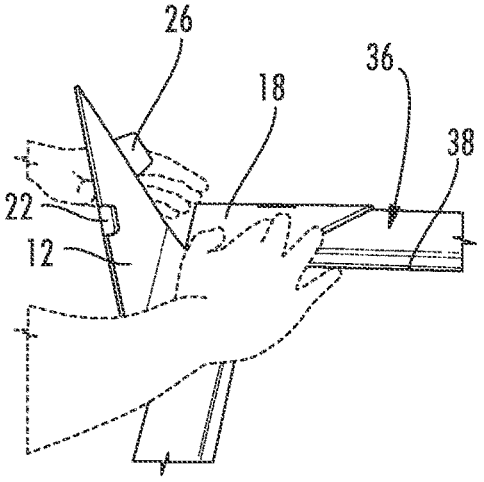
FIG. 3B is a perspective view of another step of a mounting procedure to mount the package body of FIG. 1 to the frame of FIG. 2.
Figure 3C:
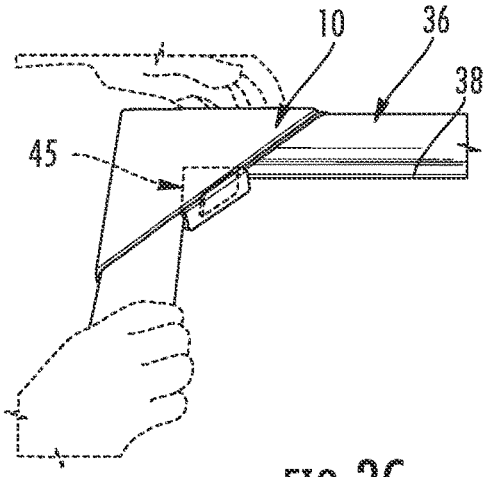
FIG. 3C is a perspective view of yet another step of a mounting procedure to mount the package body of FIG. 1 to the frame of FIG. 2.

FIGS. 3A through 3C show an example of a method to fold the package body 10 about the frame 36, through the opening 38, and to secure the package body 10 to the frame 36. In FIGS. 3A through 3C, the back panel 12 and the rollover flap 18 are shown in an alternative configuration relative to FIG. 1. In FIG. 3A, the back panel 12 and the rollover flap 18 are shown folded upward relative to the front panel 14 resting upon an underlying surface. The inside panel 16 is shown folded with portions below the frame 36 and portions defining a cavity as further described below. The inside panel 16 is shown extending through the opening 38 of the frame 36. In FIG. 3B, the rollover flap 18 is shown folded downward toward the front panel 14 and over a corner portion of the frame 36. In FIG. 3C, the back panel 12 is shown folded downward toward the front panel 14, the inside panel tab 22 is inserted within the inside panel tab slot 28, and the side panel tab 26 is inserted within the side panel slot 30.

As mentioned above, the inside panel 16 may define a cavity within the opening 38 and adjacent the corner portion of the frame 36. The inside panel 16 may include flaps 40 for orientation below the frame 36 and upon the front panel 14. The remaining portions of the inside panel 16 adjacent the inside panel tab slot 28 may be folded to define a cavity, such as a cavity 45 (shown in FIG. 3C). The cavity 45 may be located within or partially within the opening 38 and may operate as a storage area to house components, such as mount components, of the frame 36. The cavity 45 may also provide additional protection to a portion of the frame 36 adjacent thereto and be arranged with the frame 36 such that a user may move the frame 36 by grasping the package body 10 at the cavity 45. The cavity 45 may also provide an exterior surface for applying marketing or other indicia thereto. It is contemplated that the size and shape of the back panel 12, front panel 14, and the rollover flap 18 may be such that a cavity is defined at an outer portion of the frame 36.

Figure 4:
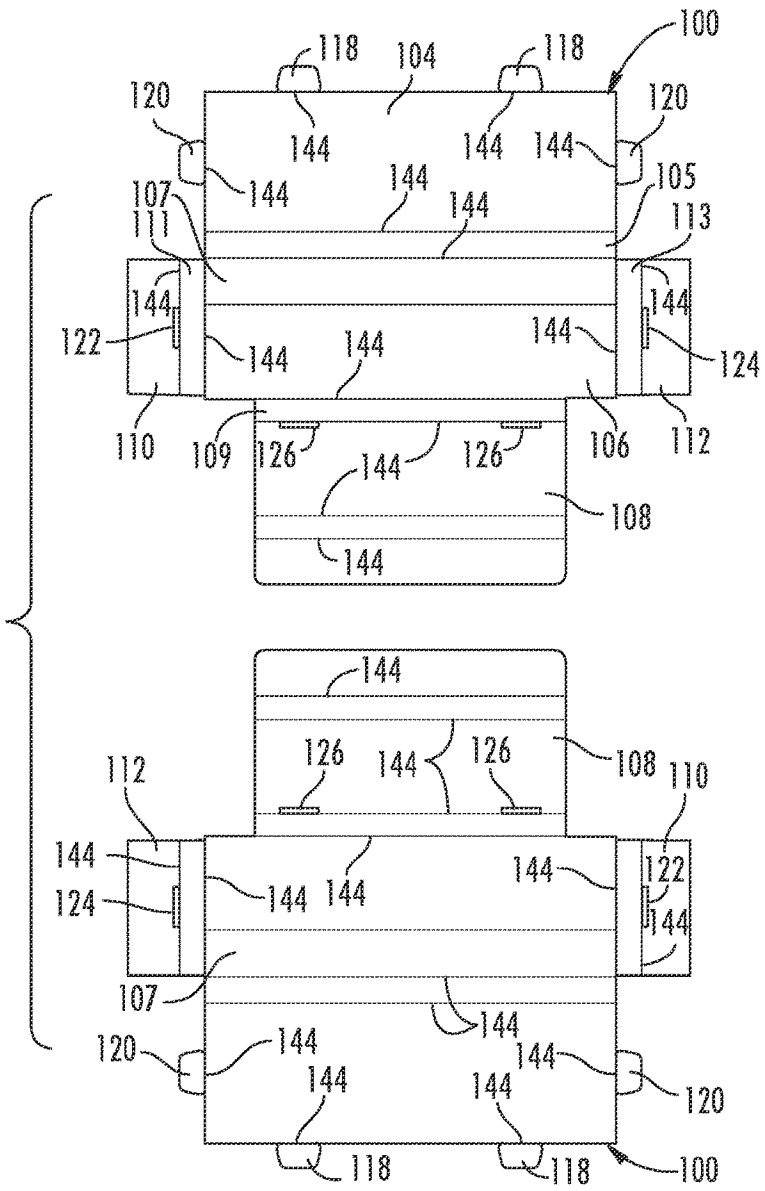
FIG. 4 is a plan view of an example of two package bodies unfolded and for securing to a frame.

FIG. 4 shows an example of a frame package including two package bodies for a frame, each referred to generally as a package body 100 herein. The package body includes a back panel 104, a front panel 106, a bottom panel 108, a first side panel 110, and a second side panel 112. The back panel 104 includes tabs for insertion within slots defined by the other panels. For example, the back panel 104 includes a pair of back panel tabs 118 extending from an upper portion of the back panel 104 and a pair of side panel tabs 120 extending from opposing side portions of the back panel 104. The front panel 106 may include a region 107 sized to rest upon a portion of a frame, such as an upper or lower portion of a picture frame or mirror frame.

The back panel 104 includes a first side portion 105, the bottom panel 108 includes a second side portion 109, the first side panel 110 includes a third side portion 111, and the second side panel 112 includes a fourth side portion 113. The side portions may be sized so that the back panel 104, the bottom panel 108, the first side panel 110, and the second side panel 112 may rest snuggly upon the frame 130 when the package body 100 is secured to the frame 130.

The first side panel 110 may define a first side panel slot 122 sized to receive one of the side panel tabs 120. The second side panel 112 may define a second side panel slot 124 sized to receive one of the side panel tabs 120. The bottom panel 108 may define a pair of back panel slots 126. Each of the back panel slots 126 may be sized to receive one of the back panel tabs 118. While this example shows tabs for insertion with slots, it is contemplated that other configurations are available in which a portion of the package body 100 is secured to another portion of the package body 100 and not secured to the frame 130.

Figure 5:
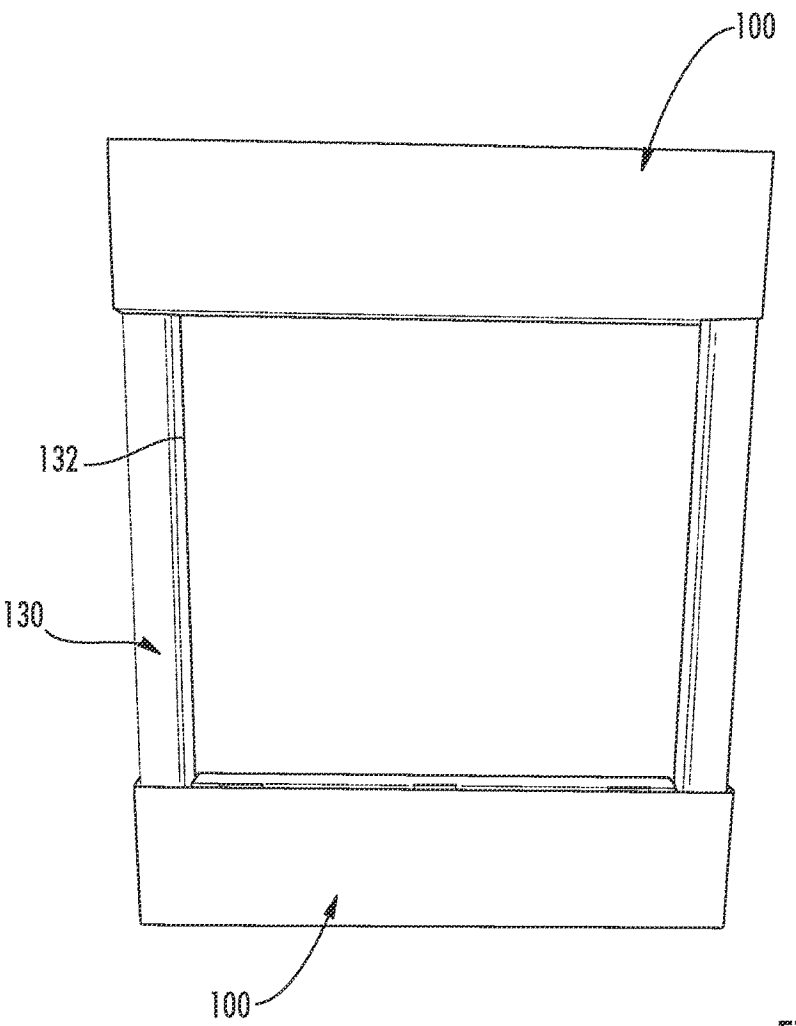
FIG. 5 is a perspective view of the package bodies of FIG. 4 shown mounted to a frame.

The panels of the package body 100 may be arranged with one another to fold about a portion of a frame and through an opening defined by the frame. FIG. 5 shows an example of two package bodies 100 folded about an upper portion and a lower portion of a frame 130, and each of the package bodies 100 extending through an opening 132 defined by the frame 130. Each of the package bodies 100 is secured to the frame 130 without an additional fastener.

For example, the package body 100 may include fold seams 144 located at portions of the package body 100 to assist in facilitating securement of the package body 100 to the frame 130. The fold seams 144 may be pre-scored and include fold instruction indicia adjacent thereto (e.g. "Fold along this line."). Panels and tabs adjacent the fold seams 144 may fold in either direction about the respective fold seam 144.

Figure 6A:
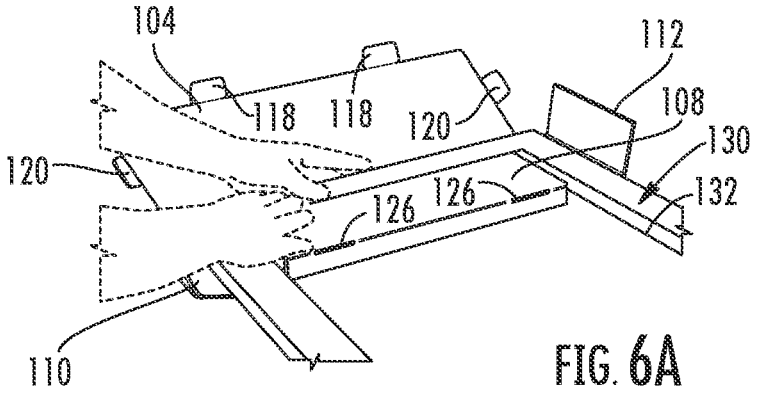
FIG. 6A is a perspective view of a step of a mounting procedure to mount one of the package bodies of FIG. 4 to the frame of FIG. 5.
Figure 6B:
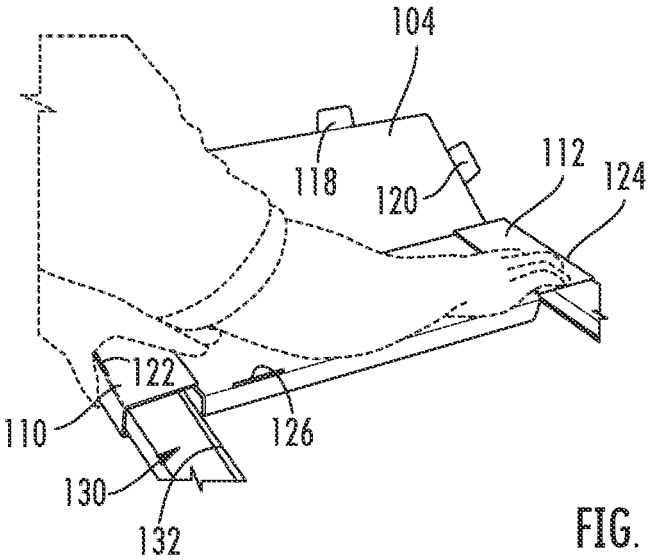
FIG. 6B is a perspective view of another step of a mounting procedure to mount one of the package bodies of FIG. 4 to the frame of FIG. 5.
Figure 6C:
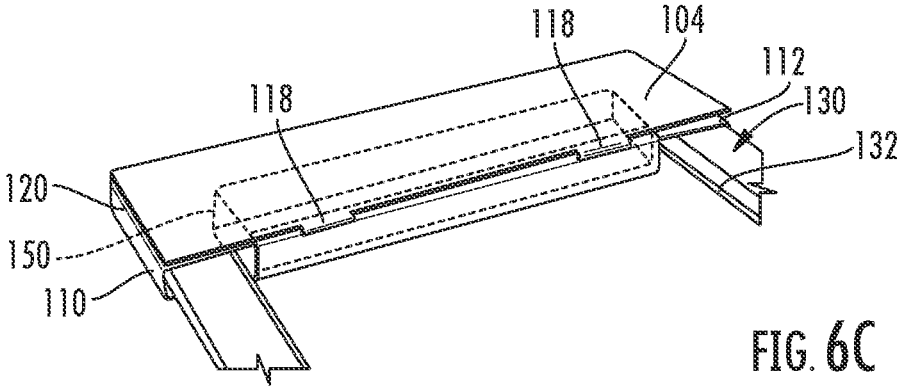
FIG. 6C is a perspective view of yet another step of a mounting procedure to mount one of the package bodies of FIG. 4 to the frame of FIG. 5.

FIGS. 6A through 6C show an example of a method to fold the package body 100 about the frame 130, through the opening 132, and to secure the package body 100 to the frame 130. In FIG. 6A the back panel 104, the first side panel 110, and the second side panel 112 are folded upward relative to the front panel 106 resting upon an underlying surface. In FIG. 6B, portions of the bottom panel 108, the first side panel 110, and the second side panel 112 are shown folded downward toward the front panel 106 and over a portion of the frame 130. The bottom panel 108 is shown extending through the opening 132 of the frame 130. In FIG. 6C, the back panel 104 is shown folded downward toward the front panel 106, the back panel tabs 118 are inserted within the back panel slots 126 and the side panel tabs 120 are each inserted within one of the first side panel slot 122 and the second side panel slot 124.

The panels may be arranged with one another and sized to define a cavity, such as a cavity 150 (shown in FIG. 6C). The cavity 150 may be oriented at least partially within the opening 132. The cavity 150 may operate as a storage area to house components, such as mount components, of the frame 130. The cavity 150 may also provide additional protection to a portion of the frame 130 adjacent thereto and be arranged with the frame 130 such that a user may move the frame 130 by grasping the package body 100 at an outer surface partially defining cavity 150. The cavity 150 may also provide an exterior surface for applying marketing or other indicia thereto. It is contemplated that the size and shape of the panels may be such that a cavity is defined at an outer portion of the frame 130.

Figure 7:
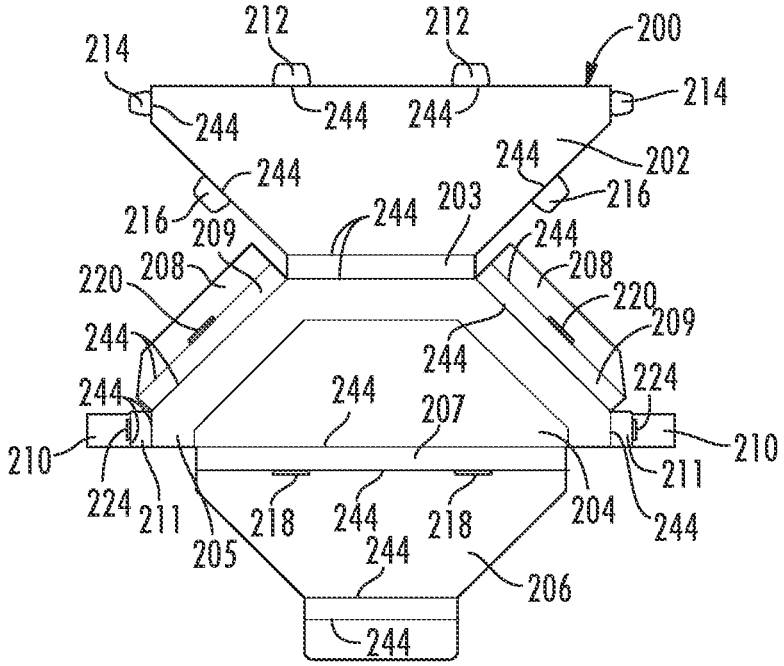
FIG. 7 is a plan view of an example of a package body unfolded and for securing to a frame.

FIG. 7 shows an example of a frame package including a package body for a frame, referred to generally as a package body 200 herein. The package body 200 includes a back panel 202, a front panel 204, a bottom panel 206, a pair of angle panels 208, and a pair of side panels 210. The back panel 202 may include tabs extending therefrom and sized for insertion within slots defined by the other panels. For example, the back panel 202 may include a pair of back panel tabs 212 extending from an upper portion of the back panel 202. Each of a pair of side panel tabs 214 may extend from one of opposing sides of the back panel 202. Each of a pair of angle panel tabs 216 may extend from one opposing angled side portions of the back panel 202. The front panel 204 may include a region 205 sized to rest upon a portion of frame such as a picture frame or a mirror frame.

The back panel 202 may include a first side portion 203, the bottom panel 206 may include a second side portion 207, each of the angle panels 208 may include a third side portion 209, and each of the pair of side panels 210 may include a fourth side portion 211. The side portions may be sized so that the back panel 202, the bottom panel 206, each of the angle panels 208, and each of the pair of side panels 210 may rest snuggly upon the frame 230 when the package body 200 is secured to the frame 230.

The bottom panel 206 may define a pair of back panel slots 218 each sized to receive one of the back panel tabs 212. Each of the angle panels 208 may define an angle panel slot 220 sized to receive one of the angle panel tabs 216. Each of the side panels 210 may define a side panel slot 224 sized to receive one of the side panel tabs 214. While this example shows tabs for insertion with slots, it is contemplated that other configurations are available in which a portion of the package body 200 is secured to another portion of the package body 200 and not secured to the frame 230.

Figure 8:
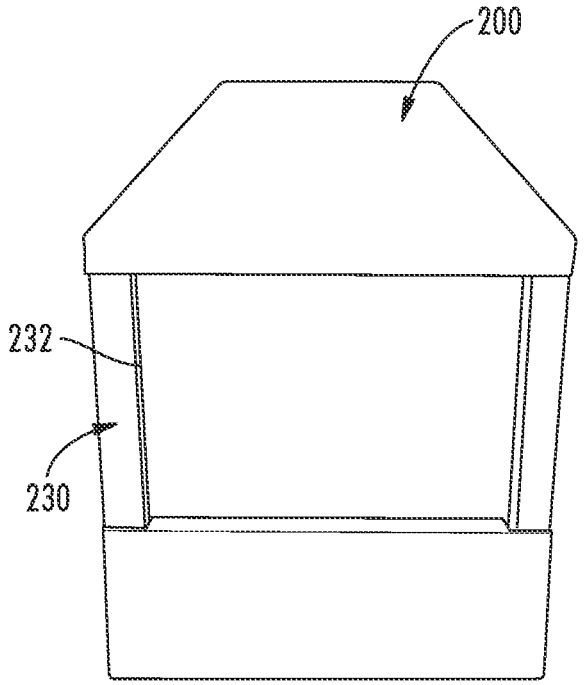
FIG. 8 is a perspective view of the package body of FIG. 7 shown mounted to a frame.

The panels of the package body 200 may be arranged with one another to fold about a portion of a frame and through an opening defined by the frame. FIG. 8 shows an example of the package body 200 folded about an upper portion of a frame 230 and extending through an opening 232 defined by the frame 230. In this example, the frame 230 is not square or rectangle-shaped at an upper portion. FIG. 6 also shows the package body 200 folded about a lower portion of the frame 230 and extending through the opening 232. Each of the package bodies is secured to the frame 230 without additional fasteners. It is contemplated that two package bodies 200 may be secured to a frame in which a lower portion also includes angles similar to the upper portion of the frame 230.

For example, the package body 200 may include fold seams 244 located at portions of the package body 200 to assist in facilitating securement of the package body 200 to the frame 230. The fold seams 244 may be pre-scored and include fold instruction indicia adjacent thereto (e.g. "Fold along this line."). Panels and tabs adjacent the fold seams 244 may fold in either direction about the respective fold seam 244.

Figure 9A:
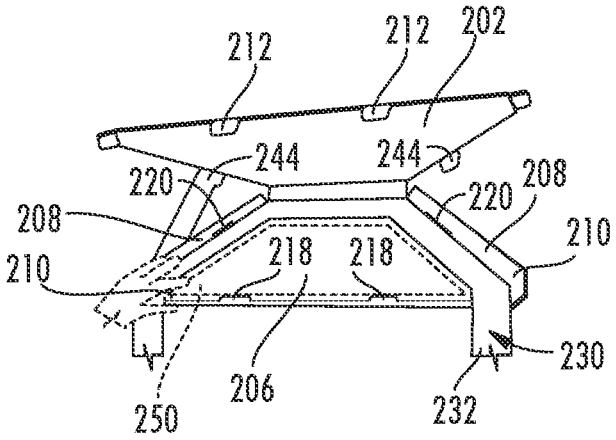
FIG. 9A is a perspective view of a step of a mounting procedure to mount the package body of FIG. 7 to the frame of FIG. 8.
Figure 9B:
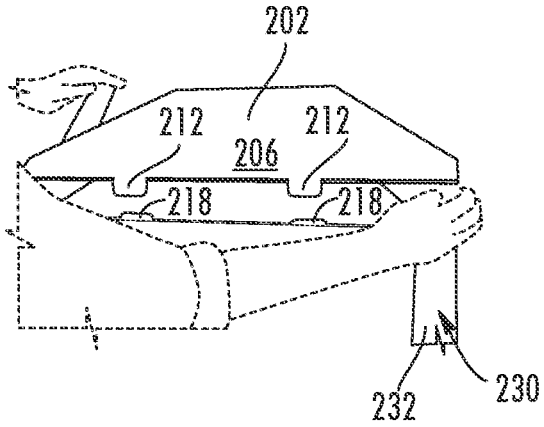
FIG. 9B is a perspective view of another step of a mounting procedure to mount the package body of FIG. 7 to the frame of FIG. 8.
Figure 9C:
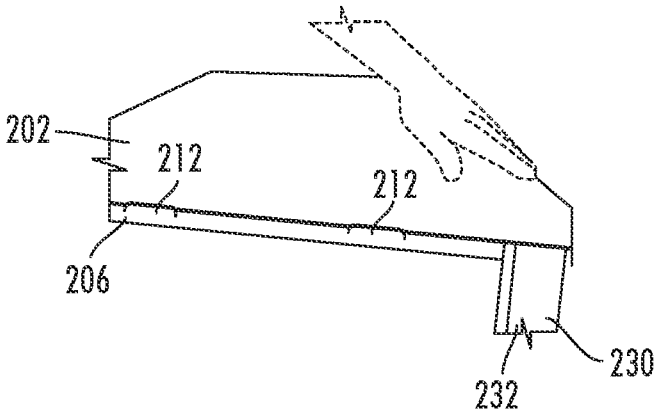
FIG. 9C is a perspective view of yet another step of a mounting procedure to mount the package body of FIG. 7 to the frame of FIG. 8.

FIGS. 9A through 9C show an example of a method to fold the package body 200 about the frame 230, through the opening 232, and to secure the package body 200 to the frame 230. In FIG. 9A, the back panel 202, the bottom panel 206, the angle panels 208, and the side panels 210 are folded upward relative to the front panel 204 resting upon an underlying surface. In FIG. 9B, portions of the bottom panel 206, the angle panels 208, and the side panels 210 are shown folded downward toward the front panel 204 and over a portion of the frame 230. The bottom panel 206 is shown extending through the opening 232 of the frame 230. In FIG. 9C, the back panel 202 is shown folded downward toward the front panel 204, the back panel tabs 212 are each inserted within one of the back panel slots 218, the side panel tabs 214 are each inserted within one of side panel slots 224, and each of the angle panel tabs 216 is inserted within one of the angle panel slots 220.

The panels may be arranged with one another and sized to define a cavity, such as a cavity 250 (shown in FIG. 9A). The cavity 250 may be oriented at least partially within the opening 232. The cavity 250 may operate as a storage area to house components, such as mount components, of the frame 230. The cavity 250 may also provide additional protection to a portion of the frame 230 adjacent thereto and be arranged with the frame 230 such that a user may move the frame 230 by grasping the package body 200 at the cavity 250. The cavity 250 may also provide an exterior surface for applying marketing or other indicia thereto. It is contemplated that the size and shape of the panels may be such that a cavity is defined at an outer portion of the frame 230.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A frame package comprising:

a front panel with a region for resting upon an angled portion of a frame;

a back panel extending from a first side of the front panel;

at least one back panel tab extending from the back panel;

a bottom panel extending from a second side of the front panel and with at least one back panel tab slot;

wherein front panel, the back panel, and the bottom panel are arranged with one another to fold about the angled portion of the frame and for the bottom panel to extend through a frame opening to orient the at least one back panel tab to be received within the at least one back panel tab slot to secure the back panel to the bottom panel with the angled portion of the frame disposed therebetween;

wherein the front panel, the back panel, and the bottom panel are arranged with one another and sized to define a cavity oriented at least partially within an opening of the frame; and a pair of side panels each extending from opposite sides of the front panel and each with a side panel slot, wherein the back panel further includes at least one side panel tab extending in a direction perpendicular to a direction in which the back panel extends, and wherein the at least one side panel tab is sized for insertion within one of the side panel slots to secure the back panel to the front panel.

2. The frame package of claim 1 further comprising a pair of angle panels each extending from one of two angled portions of the front panel and each with an angle panel slot sized to receive an angle panel tab extending from the back panel.

3. The frame package of claim 2, wherein each of the pair of angle panels is shaped to conceal a portion of the angled portion of the frame.

4. The frame package of claim 1, wherein the front panel, the back panel, and the bottom panel are further arranged with one another such that receipt by the back panel tab slot of the at least one back panel tab further secures the back panel to the bottom panel without an additional fastener.

5. A packaged frame assembly comprising:

a decorative frame having at least one angled portion; and the frame package according to claim 1 installed upon the at least one angled portion of the decorative frame.

6. The frame package of claim 1, wherein the cavity is sized to store components of the frame.

7. The frame package of claim 1, wherein the cavity is sized and arranged such that a user may grasp the frame package at the cavity to move the frame package.

8. The frame package of claim 1, wherein the cavity is sized to provide an exterior surface to apply marketing or other indicia thereto.

9. A frame package comprising:

a front panel with a region for resting upon an angled portion of a frame;

a back panel extending from a first side of the front panel;

at least one back panel tab extending from the back panel;

a bottom panel extending from a second side of the front panel and with at least one back panel tab slot;

wherein front panel, the back panel, and the bottom panel are arranged with one another to fold about the angled portion of the frame and for the bottom panel to extend through a frame opening to orient the at least one back panel tab to be received within the at least one back panel tab slot to secure the back panel to the bottom panel with the angled portion of the frame disposed therebetween; and a pair of side panels each extending from opposite sides of the front panel and each with a side panel slot, wherein the back panel further includes at least one side panel tab extending in a direction perpendicular to a direction in which the back panel extends, and wherein the at least one side panel tab is sized for insertion within one of the side panel slots to secure the back panel to the front panel.

10. The frame package of claim 9 further comprising a pair of angle panels each extending from one of two angled portions of the front panel and each with an angle panel slot sized to receive an angle panel tab extending from the back panel.

11. The frame package of claim 10, wherein each of the pair of angle panels is shaped to conceal a portion of the angled portion of the frame.

12. The frame package of claim 9, wherein the front panel, the back panel, and the bottom panel are further arranged with one another such that receipt by the back panel tab slot of the at least one back panel tab further secures the back panel to the bottom panel without an additional fastener.

13. The frame package of claim 9, wherein the front panel, the back panel, and the bottom panel are arranged with one another and sized to define a cavity oriented at least partially within an opening of the frame; and wherein the cavity is sized to store components of the frame.

14. The frame package of claim 9, wherein the front panel, the back panel, and the bottom panel are arranged with one another and sized to define a cavity oriented at least partially within an opening of the frame; and wherein the cavity is sized and arranged such that a user may grasp the frame package at the cavity to move the frame package.

15. The frame package of claim 9, wherein the front panel, the back panel, and the bottom panel are arranged with one another and sized to define a cavity oriented at least partially within an opening of the frame; and wherein the cavity is sized to provide an exterior surface to apply marketing or other indicia thereto.

16. A packaged frame assembly comprising:

a decorative frame having at least one angled portion; and the frame package according to claim 9 installed upon the at least one angled portion of the decorative frame.

17. A frame package comprising:

a front panel with a region for resting upon an angled portion of a frame;

a back panel extending from a first side of the front panel;

at least one back panel tab extending from the back panel;

a bottom panel extending from a second side of the front panel and with at least one back panel tab slot;

wherein front panel, the back panel, and the bottom panel are arranged with one another to fold about the angled portion of the frame and for the bottom panel to extend through a frame opening to orient the at least one back panel tab to be received within the at least one back panel tab slot to secure the back panel to the bottom panel with the angled portion of the frame disposed therebetween;

wherein the front panel, the back panel, and the bottom panel are arranged with one another and sized to define a cavity oriented at least partially within an opening of the frame;

wherein the cavity is sized to store components of the frame;

wherein the cavity is sized and arranged such that a user may grasp the frame package at the cavity to move the frame package;

wherein the cavity is sized to provide an exterior surface to apply marketing or other indicia thereto; and a pair of side panels each extending from opposite sides of the front panel and each with a side panel slot, wherein the back panel further includes at least one side panel tab extending in a direction perpendicular to a direction in which the back panel extends, and wherein the at least one side panel tab is sized for insertion within one of the side panel slots to secure the back panel to the front panel.

18. A packaged frame assembly comprising:

a decorative frame having at least one angled portion; and the frame package according to claim 17 installed upon the at least one angled portion of the decorative frame.

* * * * *